US007441631B2

(12) United States Patent
Oh et al.

(10) Patent No.: US 7,441,631 B2
(45) Date of Patent: Oct. 28, 2008

(54) PASSIVE ULTRASONIC RFID ELEVATOR POSITIONING REFERENCE SYSTEM

(75) Inventors: Jae-Hyuk Oh, Tolland, CT (US); Alan Finn, Hebron, CT (US); Pei-Yuan Peng, Ellington, CT (US); Pengju Kang, Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 491 days.

(21) Appl. No.: 10/545,333

(22) PCT Filed: Feb. 3, 2003

(86) PCT No.: PCT/US03/03324

§ 371 (c)(1),
(2), (4) Date: Oct. 26, 2005

(87) PCT Pub. No.: WO2004/069714

PCT Pub. Date: Aug. 19, 2004

(65) Prior Publication Data

US 2006/0065489 A1 Mar. 30, 2006

(51) Int. Cl.
*B66B 3/02* (2006.01)

(52) U.S. Cl. ..... 187/394; 187/291

(58) Field of Classification Search ..... 187/247, 187/248, 391–394, 413, 414, 284, 291
See application file for complete search history.

(56) References Cited

U.S. PATENT DOCUMENTS 3,414,088 A * 12/1968 Bruns et al. ..... 187/389
4,134,476 A * 1/1979 Zolnerovich et al. ..... 187/394
4,375,057 A * 2/1983 Weise et al. ..... 187/394
4,674,604 A * 6/1987 Williams ..... 187/291
4,732,238 A * 3/1988 Baumgartner ..... 187/317
5,223,680 A * 6/1993 Schmidt-Milkau et al. .. 187/394
5,306,882 A * 4/1994 Gerwing et al. ..... 187/394
5,677,519 A * 10/1997 Herkel et al. ..... 187/291
5,682,024 A * 10/1997 Koopman et al. ..... 187/394
5,736,695 A * 4/1998 Hoepken ..... 187/394
5,831,227 A * 11/1998 Finn et al. ..... 187/394
5,883,345 A * 3/1999 Schonauer et al. ..... 187/394
5,889,239 A * 3/1999 Blackaby et al. ..... 187/391
6,079,521 A * 6/2000 Schonauer et al. ..... 187/393
6,305,503 B1 * 10/2001 Suzuki et al. ..... 187/393
7,077,244 B2 * 7/2006 Oh et al. ..... 187/394
2006/0283670 A1 * 12/2006 Oh et al. ..... 187/394

FOREIGN PATENT DOCUMENTS

JP 02295866 A * 12/1990

* cited by examiner

*Primary Examiner*—Jonathan Salata
(74) *Attorney, Agent, or Firm*—Bachman & LaPointe, P.C.

(57) ABSTRACT

An apparatus for measuring a position of a moveable platform includes a plurality of transponder modules. The transponder modules include an electromagnetic transmitter adapted to emit an electromagnetic signal, and an acoustic receiver adapted to receive an acoustic signal. At least two of the plurality of transponders are disposed about the position to be measured. The apparatus also includes at least one transceiver module affixed to the moveable platform, which transceiver modules includes an acoustic transmitter adapted to emit an acoustic signal, an electromagnetic receiver adapted to receive an electromagnetic signal. The apparatus also includes a timing mechanism for measuring a plurality of durations between an emission of the acoustic signal and a receipt of the electromagnetic signal, and a computing mechanism for processing the plurality of durations to compute the position.

15 Claims, 1 Drawing Sheet

PASSIVE ULTRASONIC RFID ELEVATOR POSITIONING REFERENCE SYSTEM

BACKGROUND OF THE INVENTION (1) Field of the Invention

The present invention relates to an apparatus, and method for so using, ultrasonic and RF signals to establish the position of a moveable platform. More specifically, the present invention relates to a method of situating transceiver and transponder modules so as to measure the position of an elevator car in operation.

(2) Description of Related Art

A Positioning Reference System (PRS) is a component of an elevator control system that provides fast and accurate position measurement of elevator car in a hoistway. The speed and accuracy of the measurement is determined by the given elevator control system in accordance with a prescribed level of ride quality. For example, it is typically a requirement that the position measurement should be performed within a 10 ms lag and to a 1 mm accuracy. Considering the wide operating range (up to 500 m) of elevators, these performance requirements can be difficult to achieve. In addition to the performance requirements on accuracy and measurement lag, a minimized correction run is the other important performance requirement. Here, 'minimized' means less than one-floor distance.

Many existing PRSs are based on encoders that are attached to the elevator motor, governor, or independent sheaves. These PRSs suffer from differences between the encoder reading and the real position that is caused by slippage, rope stretch, mechanical wear in subsystems, and/or building sway. To minimize the difference, correction should be performed frequently based on some fixed and known referencing points showing the real position of landing floor and leveling-zone. A vane system, consisting of vane reader and vanes, provides these referencing points and their detection means. Considering the simple functionality of the vane system, the vane system is quite cost-inefficient since a vane, which is installed at every floor by a mechanic in the hoistway, costs $10 for material, 0.5 hour for installation, and about 0.1 hour for adjustment. Overall, one of the most significant problems in the existing PRSs is the poor performance to cost ratio.

What is therefore needed, is a high-accuracy positioning means with low cost for material, installation, and maintenance.

SUMMARY OF THE INVENTION

Accordingly, it is an object of the present invention to provide an apparatus, and method for using, ultrasonic and RF signals to establish the position of a moveable platform.

In accordance with the present invention, a positioning system comprises a plurality of transponder modules for receiving an ultrasonic signal and emitting an RF signal, at least one transceiver module for emitting at least one ultrasonic signal and receiving the plurality of RF signals, means for determining a duration of time between an emission of the ultrasound signal and receipt of the RF signal by the at least one transponder module, and means for determining a position of the transponder module from the durations of time.

In accordance with the present invention, an apparatus for measuring a position of a moveable platform comprises a plurality of transponder modules comprising, an RF transmitter adapted to emit an RF signal, and an ultrasonic receiver adapted to receive an ultrasonic signal wherein at least two of the plurality of transponders are disposed about the position to be measured, at least one transceiver module affixed to the moveable platform comprising, an ultrasonic transmitter adapted to emit an ultrasonic signal, an RF receiver adapted to receive an RF signal, a timing mechanism for measuring a plurality of durations between an emission of the ultrasonic signal and a receipt of the RF signal, and a computing mechanism for processing the plurality of durations to compute the position.

In accordance with the present invention, a method for measuring a position of a moveable platform comprises the steps of affixing at least one transceiver module to the moveable platform the transceiver module comprising an ultrasonic transmitter adapted to emit an ultrasonic signal, an RF receiver adapted to receive an RF signal, a timing mechanism for measuring a plurality of durations between an emission of the ultrasonic signal and a receipt of the RF signal, and a computing mechanism for processing the plurality of durations, disposing a plurality of transponder modules each at a fixed position the transponder modules comprising an RF transmitter adapted to emit an RF signal, and an ultrasonic receiver adapted to receive an ultrasonic signal, emitting from the at least one transceiver module the ultrasonic signal for receipt by the plurality of transponder modules and starting a timing mechanism, receiving the ultrasonic signal with the plurality of transponder modules each emitting an RF signal encoded with a unique code, receiving the plurality of emitted RF signals with the RF receiver, using the timing mechanism to measure at least one duration of time between emitting the ultrasonic signal and receiving each of the plurality of emitted RF signals, and computing the position of the moveable platform using the fixed positions and the at least one measured duration of time.

DETAILED DESCRIPTION OF THE PREFERRED EMBODIMENT(S)

This invention centers on a positioning concept comprised of a Passive Ultrasonic RF-ID System, in short, PURIS. The PURIS of the present invention provides a high-accuracy positioning means with low cost for material, installation, and maintenance. Central to the feasibility of the present invention is the combination of high speed electromagnetic signals and much slower acoustic signals. Preferably, the electromagnetic signals are RF signals and the acoustic signals are ultrasonic signals. As is described more fully below, this combination of high speed electromagnetic signals and slower acoustic signals are combined to provide functionality not easily attainable by the sole use of one or the other signaling technology. While described with reference to elevators, the present invention is not so limited. Rather the present invention is drawn broadly to encompass any moveable platform traveling along a fixed path wherein the path is comprised of known reference points the spatial relationship to which is to be determined.

Figure 1:
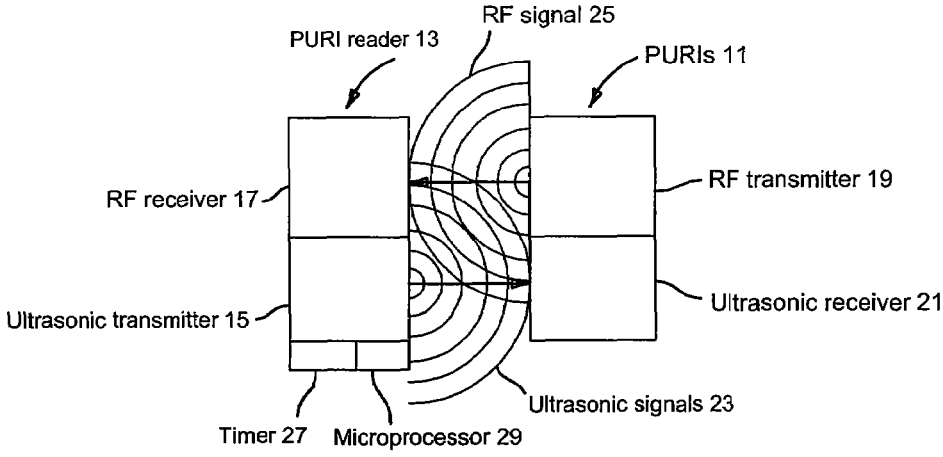
FIG. 1 A diagram of the composition and operation of the transceiver modules and transponder modules of the present invention.

With reference to FIG. 1, there is illustrated the elements of the PURIS of the present invention. PURIS consists of multiple PURIs 11, the transponder modules, and a PURI reader 13, the transceiver module. The PURI reader 13 emits ultrasonic signals 23 to activate a plurality of PURIs 11 located around the PURI reader 13. Each of the activated PURIs 11 returns a uniquely coded RF signal 25 to the PURI reader 13. The PURI reader 13 measures the time interval between ultrasonic signal emission and RF signal arrival to calculate the distance between the PURI reader 13 and the corresponding PURI 11. This measurement is preferably performed by an electronic timing mechanism 27 and the calculations are preferably performed by a microprocessor 29.

By decoding the coded RF signal 25, the PURI reader 13 can additionally identify the corresponding PURI 11 from whence the RF signal 25 originated. The sensor components of PURI 11 are an ultrasonic receiver 21 and an RF transmitter 19 while those of the PURI reader are an ultrasonic transmitter 15 and an RF receiver 17.

The operation of the system shown in FIG. 1 can be explained in more detail as follows:

First, the ultrasonic transmitter 15 in the PURI reader 13 emits an ultrasonic signal 23. The duration of the signal is preferably small enough to minimize the interference between the current signal and the former signals. Whenever the ultrasonic transmitter 15 emits an ultrasonic signal 23, the timer 27 on the PURI reader 13 is reset and starts counting clock pulses. On receiving the ultrasonic signal 23, the ultrasonic receiver 21 on the PURI 11 activates the RF transmitter 19. The RF transmitter 19 sends out a coded RF signal 25, which includes a unique ID of the PURI 11. Whenever the RF receiver 17 on the PURI reader 13 receives a coded RF signal 25, the timer 27 saves the elapsed time, together with the decoded ID. The saved time is the flight time of the ultrasonic signal from the PURI reader 13 to the PURI 11. The flight time of the coded RF signal 25 is negligible.

Since the transmitted RF signals are sufficiently short in time, the possibility of overlapping between any more than two RF signals 25 is quite low. Moreover, the RF signals 25 can be frequency modulated appropriately so that they can be separated even when they are overlapped. At the arrival of the pre-determined number of RF signals or after a pre-determined time interval, the timer stops. Finally, the position of the PURI reader 13 can be obtained by using a triangulation method using the saved times and decoded Ids, or other direction of arrival methods as are well known to one of ordinary skill in the art.

Figure 2:
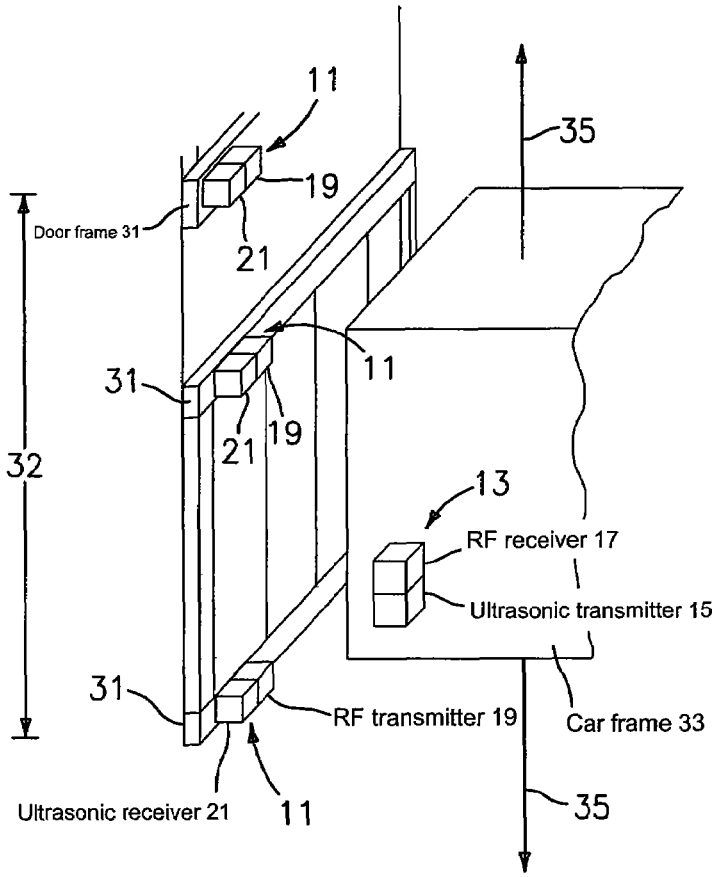
FIG. 2 A diagram of a preferred embodiment of the passive ultrasonic RFID elevator positioning reference system of the present invention.

In a preferred embodiment, the PURIs 11 are installed upon door frames 31 while a PURI 13 reader is installed upon a car frame 33 as illustrated with reference to FIG. 2. Car frame 33 moves along axis 35 such that the position of PURI reader 13 with respect to each of the at least two PURIs 11 when PURI reader 13 is in proximity to the PURIs 11 is substantially the same. PURIs 11 may be installed to door frames 31 at different positions. However, such a lack of uniformity makes necessary recording and storing the different positions of each and every PURI 11. Therefore, PURIs 11 are preferably installed to each door frame 31 at the same relative locations, and hence, the geometric relationship between a PURI reader 13 and the PURIs 11 attached to each single door frame 31 is invariant.

Thus, once the geometry is identified at a door frame 31 or a floor, the identified geometric parameters can be used for all other door frames 31 or all other floors. In the case that the location of each PURI's 11 attachment to the door frame varies from floor to floor, a training run is preferably performed whereby the PURI reader 13 is moved from one terminus of the elevator shaft to the other and the position of each PURI 11 is computed and stored for future reference.

In order to affect an accurate triangulation with an error not greater than 1 mm, the number of required PURIs per floor is at least two. Preferably, the two PURIs should be within 10 ms distance 37 (the distance traveled by sound in 10 ms) from the PURI reader, which is about 3 m, or approximately one floor distance. It is of course possible to have more than two PURIs 11 per floor. As the number of PURIs 11 increases, the error in the computed position of the PURI reader 13 is reduced.

It is apparent that there has been provided in accordance with the present invention an apparatus, and method for so using, comprising ultrasonic and RF signals to establish the position of a moveable platform which fully satisfies the objects, means, and advantages set forth previously herein. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A positioning system, comprising:

a plurality of transponder modules for receiving an acoustic signal and emitting an electromagnetic signal;

at least one transceiver module for emitting at least one acoustic signal and receiving said plurality of electromagnetic signals;

a computing mechanism for determining: a duration of time between an emission of said acoustic signal and receipt of said electromagnetic signal by said at least one transponder module; and a position of said transponder module from said durations of time.

2. The apparatus of claim 1, wherein said at least one transceiver module is affixed to a moveable platform.

3. The apparatus of claim 2, wherein said moveable platform is an elevator.

4. The apparatus of claim 1, wherein said acoustic signal is an ultrasonic signal and said electromagnetic signal is an RF signal.

5. An apparatus for measuring a position of a moveable platform, comprising:

a plurality of transponder modules comprising:

an RF transmitter adapted to emit an RF signal; and an ultrasonic receiver adapted to receive an ultrasonic signal wherein at least two of said plurality of transponders are disposed about said position to be measured;

at least one transceiver module affixed to said moveable platform comprising:

an ultrasonic transmitter adapted to emit an ultrasonic signal;

an RF receiver adapted to receive an RF signal;

a timing mechanism for measuring a plurality of durations between an emission of said ultrasonic signal and a receipt of said RF signal; and a computing mechanism for processing said plurality of durations to compute said position.

6. The apparatus of claim 5, wherein said moveable platform is adapted to move along a central axis.

7. The apparatus of claim 5, wherein said moveable platform comprises an elevator.

8. The apparatus of claim 5, wherein said at least two of said transponder modules are mounted on a door frame.

9. A method for determining position, comprising the steps of:

depositing a plurality of transponder modules for receiving an ultrasonic signal and emitting an RF signal at fixed positions;

depositing at least one transceiver module for emitting at least one ultrasonic signal and receiving said plurality of RF signals at a desired position;

emitting said ultrasonic signal;

receiving at least two of said plurality of RF signals;

measuring a plurality of durations of time between said emission of said ultrasound signal and said receipt of said plurality of RF signals; and determining a position of said transceiver module from said durations of time.

10. The method of claim 9, wherein said transponder module is affixed to a moving platform.

11. A method for measuring a position of a moveable platform, comprising the steps of:

affixing at least one transceiver module to said moveable platform said transceiver module comprising:

an ultrasonic transmitter adapted to emit an ultrasonic signal;

an RF receiver adapted to receive an RF signal;

a timing mechanism for measuring a plurality of durations between an emission of said ultrasonic signal and a receipt of said RF signal; and a computing mechanism for processing said plurality of durations;

disposing a plurality of transponder modules each at a fixed position said transponder modules comprising:

an RF transmitter adapted to emit an RF signal; and an ultrasonic receiver adapted to receive an ultrasonic signal;

emitting from said at least one transceiver module said ultrasonic signal for receipt by said plurality of transponder modules and starting a timing mechanism;

receiving said ultrasonic signal with said plurality of transponder modules each emitting an RF signal encoded with a unique code;

receiving said plurality of emitted RF signals with said RF receiver;

using said timing mechanism to measure at least one duration of time between emitting said ultrasonic signal and receiving each of said plurality of emitted RF signals; and computing said position of said moveable platform using said fixed positions and said at least one measured duration of time.

12. The method of claim 11, comprising the additional step of performing a training run whereby said fixed positions of said plurality of transponder modules are calculated and stored.

13. The method of claim 11, wherein said disposing said plurality of transponder modules comprises the step of disposing said at least two transponder modules per a floor of a building.

14. The method of claim 11, wherein said disposing said plurality of transponder modules comprises the step of disposing said at least two transponder modules in a line parallel to a central axis along which said moveable platform travels.

15. The method of claim 11, wherein said disposing at least one transceiver module affixed to said moveable platform comprises disposing said at least one transceiver module to an elevator car.

* * * * *